US006289080B1

(12) United States Patent
Hasz et al.

(10) Patent No.: US 6,289,080 B1
(45) Date of Patent: Sep. 11, 2001

(54) X-RAY TARGET

(75) Inventors: Wayne Charles Hasz, Pownal, VT (US); Mark Gilbert Benz, Burnt Hills, NY (US); Charles Gitahi Mukira, Watervliet, NY (US); Thomas Robert Raber, Schenectady, NY (US); Gregory Alan Steinlage, Northfield; Gregory Reznikov, Akron, both of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/442,323

(22) Filed: Nov. 22, 1999

(51) Int. Cl.[7] ..... H01J 35/08
(52) U.S. Cl. ..... 378/143; 378/144
(58) Field of Search ..... 378/143, 144

(56) References Cited

U.S. PATENT DOCUMENTS 4,641,333 * 2/1987 Goossens et al. ..... 378/143
5,099,506 * 3/1992 Van Der Kooi et al. ..... 378/143
5,592,525 1/1997 Reznikov et al. .

OTHER PUBLICATIONS

Doctor–Blade Process, by J. C. Wiliams,in Treatise on Materials Science and Technology, vol. 9, Ceramic Fabrication Processes, Academic Press, pp. 173–197 (1976).

* cited by examiner

*Primary Examiner*—David P. Porta
(74) *Attorney, Agent, or Firm*—Toan P. Vo; Noreen C. Johnson

(57) ABSTRACT

An improved X-ray tube target comprises a refractory metal target substrate and a refractory metal focal track applied to the target substrate by a tape casting process. The X-ray tube target comprises a refractory metal target substrate and a refractory metal focal track formed on the target substrate to form a focal track/target substrate interface plane that varies less than about ±0.13 mm.

9 Claims, 2 Drawing Sheets

X-RAY TARGET

BACKGROUND OF THE INVENTION

The present invention relates to a high performance X-ray generating target. More particularly, the invention is directed to a method of making a high performance rotating X-ray tube anode structure having an improved target face.

X-rays are produced when electrons are released in a vacuum within an X-ray tube, accelerated and then abruptly stopped. The electrons are initially released from a heated, incandescent filament. A high voltage between an anode and cathode accelerates the electrons and causes them to impinge upon the anode. The anode, usually referred to as the target, can be a rotating disc type so that the electron beam constantly strikes a different point on the target surface. The X-ray tube contains the cathode and anode assembly, which includes the rotating disk target and a rotor that is part of a motor assembly that spins the target. A stator is provided outside the X-ray tube vacuum envelope, overlapping about two-thirds of the rotor. The X-ray tube is enclosed in a protective casing having a window for the X-rays that are generated to escape the tube. The casing is filled with oil to absorb heat produced by the X-rays.

The rotating X-ray tube target includes a refractory metal target substrate and a target focal track of an X-ray emitting metal joined to the target substrate along an interface. Tungsten alone and tungsten alloyed with other metals are commonly used in X-ray targets. Metals, which are sometimes alloyed with the tungsten in small amounts, include rhenium, osmium, irridium, platinum, technetium, ruthenium, rhodium and palladium. X-ray targets formed wholly from tungsten or from tungsten alloys where tungsten is the predominant metal are characterized by high density and weight. Additionally, tungsten is notch sensitive and extremely brittle and is thereby subject to catastrophic failure. Because of these shortcomings, X-ray targets typically comprise a tungsten or tungsten alloy target focal track and a target substrate of another metal or alloy. Typically, molybdenum and molybdenum alloy are used for the target substrate.

An X-ray target is typically formed by a powder metallurgy technique wherein metal powder to form the target focal track is placed against metal powder to form the target substrate. The resulting powder mass is pressed, sintered and then forged and machined to form the target.

The process results in an uneven surface and thickness and an uneven interface between target focal track and target substrate metal. The focal track metal is relatively heavier than the target substrate metal and the uneven thickness can cause an imbalance in the rotating target. Thin and thick areas in the track produce stress at the track/target interface that can cause localized grain growth and delamination. The inability to accurately control the thickness of the track metal requires that an excess of expensive track metal be applied to the target substrate to assure that no target substrate metal is left exposed. There is a need for a process to apply a focal track with both an even surface and an even interface between track and X-ray target substrate.

SUMMARY OF THE INVENTION

The invention provides an improved X-ray tube rotary anode. The anode comprises a refractory metal target substrate and a refractory metal focal track formed on the substrate with a focal track/target substrate interface that varies less than about ±0.13 mm from a perfect plane interface between track and target substrate.

In an embodiment, the invention relates to an X-ray tube having a rotating anode assembly comprising a refractory metal target substrate and a refractory metal focal track formed on the substrate with a focal track/target substrate interface that varies less than about ±0.13 mm from a perfect plane interface between track and target substrate.

In another embodiment, the invention relates to a process of making an X-ray target. In the process, a refractory metal is deposited onto a surface to form a tape. The X-ray target is formed from the tape applied to a refractory metal substrate.

In another embodiment, the invention relates to a process of forming an X-ray target, comprising casting a slurry of a powder in a solvent containing a binder onto a casting surface, evaporating the solvent from the slurry to produce a tape of a shaped layer removably adhering to the casting surface, densifying the tape to increase its green strength, peeling the casting surface from the shaped layer, forming a pack from the shaped layer and an X-ray target substrate-forming material and sintering the pack to produce the X-ray target.

DETAILED DESCRIPTION OF THE INVENTION

In the invention, an X-ray target is formed with a smooth even surface and a uniform thickness with improved bonding at target focal track/target substrate interface. The improved bonding resists cracking and delamination and avoids exposure of target substrate metal when the focal track is machined. The focal track can be formed by tape casting, slip casting, roll compaction, slurry spraying, thermal spraying or waterfall processing.

These and other features will become apparent from the drawings which by way of example, without limitation illustrate embodiments of the invention.

Figure 1:
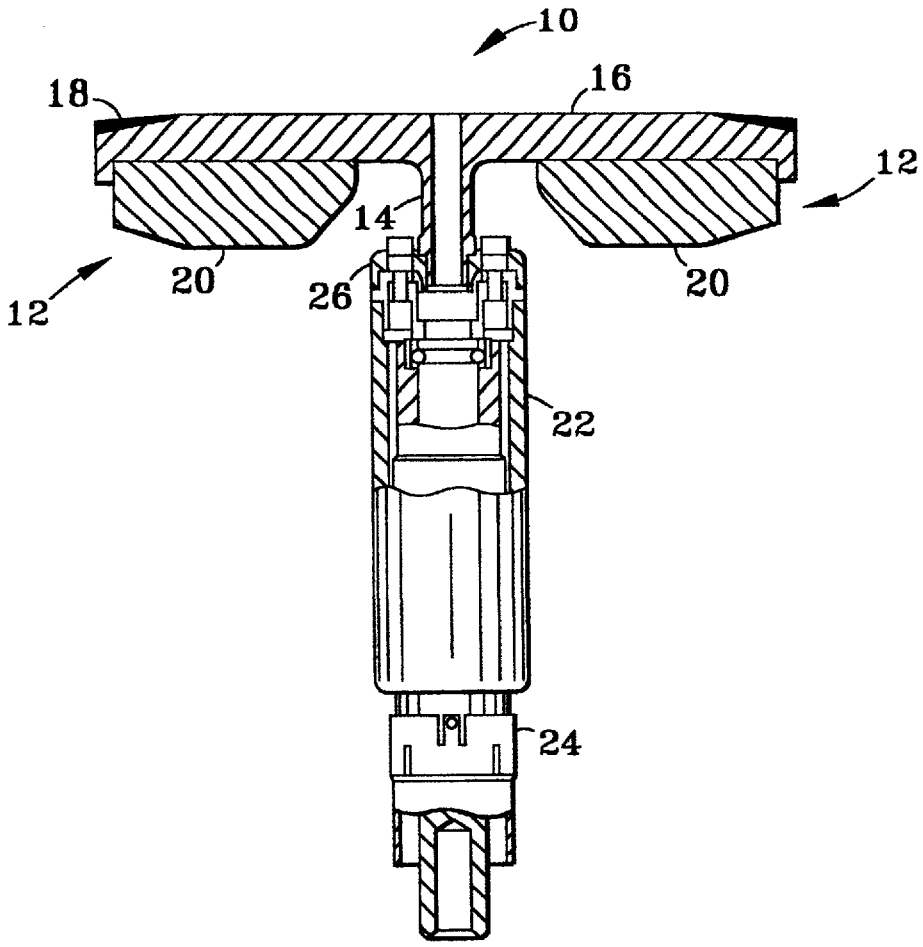
FIG. 1 is a sectional view of an X-ray tube target and stem assembly of the invention.
Figure 2:
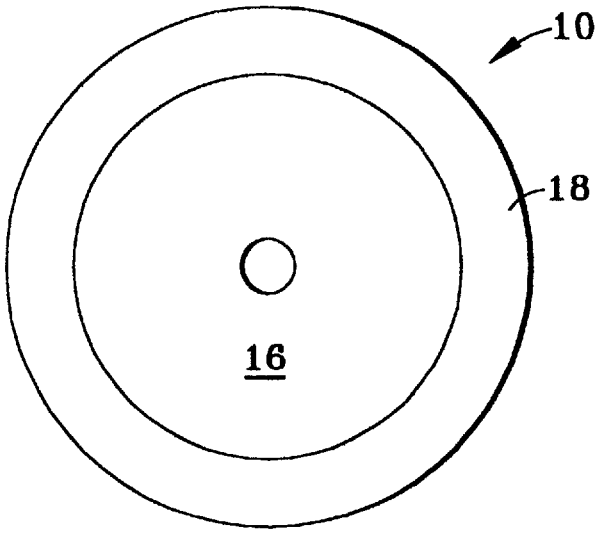
FIG. 2 is a top view of the assembly of FIG. 1 showing the target substrate and focal track.

FIGS. 1 and 2 are schematic views of a representation of an X-ray tube 10 that includes rotating anode assembly 12 and stem 14. The anode assembly 12 includes target substrate 16 typically of molybdenum alloy TZM and target focal track 18 typically made of a tungsten-rhenium alloy. The target substrate 16 is backed by graphite ring 20, which is brazed to target substrate 16. Electrons generated by a cathode (not shown) impinge on focal track 18, which emits X-rays.

The anode assembly 10 is rotated by an induction motor comprising cylindrical rotor 22 built around axle 24. The axle 24 supports disc shaped target substrate 16 with focal track 18 on the front and graphite ring 20 on the back. The anode assembly 12 is connected via a stem 14 and hub 26 to rotor 22 and axle 24, which contains bearings to facilitate rotation. The rotor 22 of the rotating anode assembly 10, driven by a stator induction motor, is at anodic potential while the stator is electrically grounded.

In a typical X-ray tube, the anode and cathode assemblies are sealed in a vacuum frame and mounted in a conductive metal housing. An insulation material is provided between the stator and the glass frame and rotor.

Figure 5:
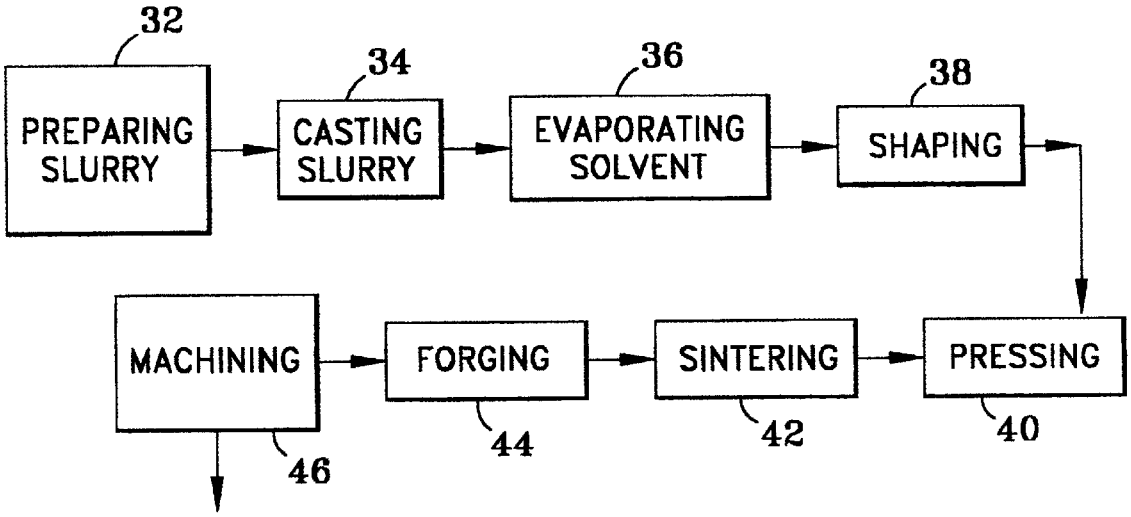
FIG. 5 is a schematic representation of a process of forming an X-ray target.

In accordance with the invention, target focal track 18 is formed on target substrate 16 by a tape cast process. FIG. 5 schematically illustrates a process of making an X-ray target including a first step 32 wherein metal alloy powders are slurried with an inert solvent binder such as a polyethylene oxide or a fully saturated aliphatic such as hexane, heptane or organic or water-based mixture such as polyethylene oxide/water or toluene/polyvinyl butyral and the like that evaporates at about room temperature up to about 200° C. The solvent includes a binder that holds the metal powder together and that burns out cleanly without residue.

The metal powder is preferably tungsten or a tungsten alloy powder such as a tungsten/rhenium (W—Re). However, other suitable metals and alloys such as rhenium, rhodium, molybdenum or other heavy metals can be used. The metals and alloys are selected primarily for their high melting points (>1500° C.). The W—Re is prepared by conventional powder processing techniques. The particle size of the powder should be about 2 to 8 microns in size.

The metal powder can comprise between about 50 and about 98 weight percent, desirably between about 84 and about 96, and preferably between about 87 and about 94 weight percent of the slurry. The binder can comprise between about 5 and about 20 weight percent, desirably between about 7 and about 16, and preferably between about 8 and about 13 weight percent of the slurry. Various known slurry modifying agents may be employed to control viscosity and other properties as long as they cleanly burn out without residue during sintering. The viscous character of the organic vehicle and fine particle size combine to form relatively stable slurries that resist rapid settling.

Distilled water can be added to the slurry in water-based systems to adjust viscosity to provide a smooth consistency suitable for casting. The distilled water can be slowly added while slurry consistency is observed until the slurry can flow when tilted at a 45° angle off vertical. The slurry can be de-aired. De-airing can be performed during initial mixing of the slurry in a vacuum mixing device. Vacuum level can be less than 1 atmosphere, typically less than about 1.0E-02 Torr.

The slurry can then be cast 34 onto a casting surface, which is preferably a polytetrafluoroethylene (Teflon®), a glycol, terephthalic acid polyester (Mylar®), a cellophane or a cellulose acetate. Any spreader device for regulating amount of viscous material deposited on a surface can cast the slurry. For example, a doctor blade with a roller device is suitable. Suitable doctor blade equipment is provided by HED International, ProCast Division and other manufacturers. The slurry can be poured onto a surface and the blade then passed through the slurry for leveling or the slurry can be fed into a doctor blade device and applied under the blade edge to create a flat ribbon of tape with a width dimension greater than a desired diameter of a focal track.

The process can include other steps such as milling and filtering, if necessary or desired. Additionally, other processes for forming a green tape can be used, including roll compaction, slip casting, slurry spraying, thermal spraying and waterfall casting.

Solvent is evaporated 36 from the cast slurry to produce a flexible tape removably adhering to the casting surface. The evaporation rate can be controlled by controlling humidity to avoid cracking. For example, the humidity can be controlled at about 85% to about 95% at room temperature by enveloping the drying tape in an enclosure to induce higher humidity or by using a counter flow of air confined to a small area to induce a lower humidity. A slow evaporation rate is preferred. When the slurry is prepared with deionized water, evaporation can be carried out at a temperature less than about 93° C. Preferably, the evaporation is carried out at about room temperature (26° C.). A flawless flat layer is provided after evaporation.

The tape and cast layer are sufficiently flexible that they can be handled or stored as a unit or immediately shaped 38 by trimming. Preferably, the tape is trimmed to an annular shape to provide layers for direct pressing as a target focal track. In one aspect, annular rings of appropriate size can be punched from the tape by a die press or the like. After shaping, the tape is peeled from the casting surface and formed into a focal track on a target substrate. Preferably, the tape in an annular shape is placed in a pressing die such as a standard hydraulic pressing die target capable of applying a 1500 ton or less pressure. A metal powder to form the target substrate can be placed on top of the annular tape and pressed 40 to form a pack. Molybdenum alloys like titanium-zirconium-molybdenum (TZM) are suitable metals to form the target substrate. The pack can be compressed in the die by application of a compression force typically of between about 32 tons/cm$^2$ and about 226 tons/cm$^2$, desirably between about 65 tons/cm$^2$ and about 194 tons/cm$^2$ and preferably between about 97 tons/cm$^2$ and about 162 tons/cm$^2$.

In one embodiment of the invention, an annular ring die can be used to contain a thick ring of cast metal. After leveling and drying, the ring can be removed and the thick ring used for further processing to create a thick layer that can be used in the pressing die in place of multiple thin tapes for the formation of thick focal tracks.

Next, the compressed pack can be sintered 42 to burn out binder. The pack can be placed in a suitable furnace, such as a hydrogen or vacuum furnace, and subjected to a temperature of between about 2000° C. to about 2200° C. for a period of between about 5 hours and about 10 hours in vacuum, of 10 to 20 microns.

The pack is then pre-heated at 1500° C. in a hydrogen atmosphere and then forged 44 on a mechanical press. Typically the forging step is carried out in a press with applied force of about 400 tons/cm$^2$ to about 800 tons/cm$^2$. The X-ray target is then removed from the forging die.

Figure 3:
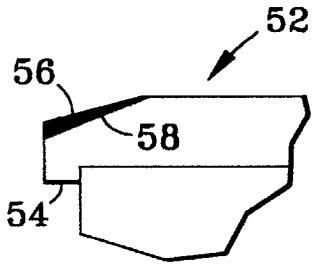
FIG. 3 PRIOR ART
FIGS. 3 and 4 are schematic representations of cut-away portions of a focal track and target substrate.
Figure 4:
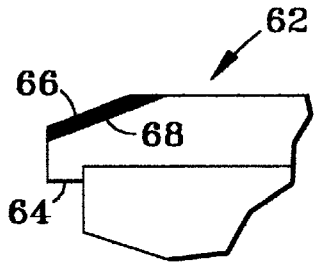

FIG. 3 is a schematic representation of a cut-away portion of a target anode 52 having a target substrate 54 and focal track 56 with focal track/substrate interface 58. FIG. 4 is schematic representation of a cut-away portion of a target anode 62 having target substrate 64 and focal track 66 with focal track/substrate interface plane 68 according to the present invention. The product of the invention can be defined with reference to the track/substrate interface plane 68. As illustrated in FIGS. 3 and 4, the cast interface plane 68 of FIG. 4 is substantially more regular than the prior art interface plane 58. The interface plane of the FIG. 4 target varies less than about ±0.13 mm from a perfect plane or surface. The variation can be as little as ±0.10 mm or ±0.05 mm from a perfect plane or surface.

The uniform layer of the casting process results in an X-ray target with improved balance. Application of a W—Re focal track onto a TZM substrate can cause thermal expansion mismatch induced stress at the focal track/target substrate interface. A uniform cast focal track reduces the effect of thermal expansion mismatch induced stress. A thinner, more uniform focal layer also reduces bi-metal bending effect, which is due to thermal expansion mismatch and thermal gradients caused by electron beam heating of the target.

While the invention advantageously reduces a need to reduce layer thickness, a machining step 46 can be utilized to further reduce layer thickness, further smooth the focal track surface and to precision size and shape the track and target substrate for final assembly. Additionally, since the focal track/substrate interface is substantially a level plane without imposing or projecting high substrate areas, the focal track layer can be machined to further reduce or smooth the track without a risk of exposing underlying target substrate metal.

The following detailed discussion describes preferred embodiments of the present invention.

EXAMPLES

The following three slurry compositions were prepared by mixing the indicated ingredients and stirring by hand with a stainless steel spatula: (1) 95.29 g of tungsten with 5% rhenium, 10.0 g polyethylene oxide binder ("PEO") and 6.79 distilled water ("DI water"); (2) 95.19 g of 2.4 um (particle size?) tungsten, 10.09 g PEO and 8.59 g DI water; (3) 95.0 g of 5.0 um tungsten, 10.19 g PEO and 8.59 g DI water.

Each slurry was placed on a Mylar® sheet. A doctor blade was set to 0.50" thickness and to 5 inches per minute travel rate and was applied to each slurry for leveling. The resulting green tape casts were allowed to set for 8 to 24 hours. Each tape was then cut to an annular shape for use as a focal track. The annular shapes were placed into the bottom of an inverted die press. The inverted die press had a punch driving into the die opening from topside. Mo alloy powder was then placed on top of each tape. The powder mass was compressed at 129.0 tons/cm$^2$ to produce a pressed powder pack.

Each pressed pack was removed from the die press and was placed in a vacuum furnace and fired at 2100° C. for 5 hrs at vacuum that ranged from 10 to 20 microns to drive gas from the pack. The binder was burned out of the W—Re tape cast layer in early stages of the heating. The powder then sintered to a stable structure at about 90% to 95% density (5% to 10% porosity). The water based binder system was found to burn out cleanly. Each sintered target was then heated in a hydrogen furnace at 1500° C. in hydrogen and forged at 516.1 tons/cm$^2$.

Small scale tapes fabricated according to the above procedure, were placed on a top face of a small target, 3" in diameter. Three targets were fabricated using 1, 2 and 3 layers of tape cast, respectively, to form focal tracks to determine the effect of stacking. Each focal track layer remained flat and uniform throughout the processing steps. No delamination was visible between multiple layers of the targets. The focal tracks appeared well bonded to bulk target metal.

The Examples show that tape cast W—Re focal track layers can be used to produce a bi-metal X-ray target without visible delamination at the focal track/TZM target substrate interface and that multiple layers of tape cast W—Re layers can be stacked to create a thicker focal track suitable in a manufacturing operation.

While preferred embodiments of the invention have been described, the present invention is capable of variation and modification and therefore should not be limited to the precise details of the Examples. For example, the pack can be pre-sintered and then die pressed. The pressed pack can then be finally sintered. Pre-sintering the pack can reduce shrinkage in the final focal track. Or in another embodiment, the tape can be densified on the casting surface, peeled and applied to a formed target substrate by brazing or the like. Or in still another embodiment, the tape supported by the casting surface is placed in the pressing die. The tape is removed only after the track is pressed to form the pack. The invention includes changes and alterations that fall within the purview of the following claims.

What is claimed is:

1. An X-ray tube anode comprising:

a refractory metal target substrate; and a refractory metal focal track formed on said target substrate with a focal track/target substrate interface that varies less than about ±0.13 mm from a perfect plane interface between said target substrate and said track.

2. The X-ray tube anode of claim 1, wherein said focal track/target substrate interface varies less than about ±0.10 mm from said perfect plane interface between said target substrate and said track.

3. The X-ray tube anode of claim 1, wherein said focal track/target substrate interface varies less than about ±0.05 mm from said perfect plane interface between said target substrate and said track.

4. The X-ray tube anode of claim 1, wherein said focal track has a surface that varies less than about ±0.13 mm.

5. The X-ray tube anode of claim 1, wherein said focal track has a surface that varies less than about ±0.10 mm.

6. The X-ray tube anode of claim 1, wherein said focal track surface varies less than about ±0.05 mm.

7. The X-ray tube anode of claim 1, wherein said refractory metal target substrate comprises a titanium-zirconium-molybdenum alloy or a titanium-zirconium-molybdenum with carbon alloy.

8. The X-ray tube anode of claim 1, wherein said focal track is formed by tape casting, slip casting, roll compaction, slurry spraying, thermal spraying or waterfall processing.

9. An X-ray tube having a rotating anode assembly comprising the X-ray tube anode of claim 1.

* * * * *